US007766606B2

(12) United States Patent
Liang

(10) Patent No.: US 7,766,606 B2
(45) Date of Patent: Aug. 3, 2010

(54) TURBINE AIRFOIL COOLING SYSTEM WITH PLATFORM COOLING CHANNELS WITH DIFFUSION SLOTS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 837 days.

(21) Appl. No.: 11/506,077

(22) Filed: Aug. 17, 2006

(65) Prior Publication Data

US 2010/0135772 A1 Jun. 3, 2010

(51) Int. Cl.
*F01D 5/18* (2006.01)

(52) U.S. Cl. ..... 415/115; 416/97 R; 416/193 A

(58) Field of Classification Search ..... 415/115; 416/96 R, 97 R, 193 A
See application file for complete search history.

(56) References Cited

U.S. PATENT DOCUMENTS

| | | | | |
|---|---|---|---|---|
| 3,610,769 | A | 10/1971 | Schwedland et al. | |
| 3,628,880 | A | 12/1971 | Smuland et al. | |
| 3,804,551 | A | 4/1974 | Moore | |
| 4,012,167 | A | 3/1977 | Noble | |
| 4,017,210 | A | 4/1977 | Darrow | |
| 4,244,676 | A | 1/1981 | Grondahl et al. | |
| 5,513,955 | A | 5/1996 | Barcza | |
| 6,059,529 | A | 5/2000 | Schiavo | |
| 6,190,128 | B1 | 2/2001 | Fukuno et al. | |
| 6,196,799 | B1 * | 3/2001 | Fukue et al. | 416/97 R |
| 6,390,774 | B1 | 5/2002 | Lewis et al. | |
| 6,416,282 | B1 | 7/2002 | Beeck et al. | |
| 6,420,677 | B1 * | 7/2002 | Emer et al. | 219/121.71 |
| 6,554,570 | B2 | 4/2003 | Dailey | |
| 6,616,405 | B2 * | 9/2003 | Torii et al. | 416/97 R |
| 6,887,033 | B1 | 5/2005 | Phillips et al. | |
| 2005/0058545 | A1 * | 3/2005 | Cardenas | 416/97 R |
| 2005/0095128 | A1 | 5/2005 | Benjamin et al. | |

FOREIGN PATENT DOCUMENTS

| | | |
|---|---|---|
| EP | 1 491 722 A2 | 12/2004 |

* cited by examiner

*Primary Examiner*—Edward Look
*Assistant Examiner*—Nathaniel Wiehe

(57) ABSTRACT

A cooling system for a turbine airfoil of a turbine engine having suction side platform cooling channels and pressure side platform cooling channels for cooling hot spots in a platform attached to a turbine blade. The cooling system may include one or more pressure side platform cooling chambers having a diffusion slot for cooling downstream platforms on the suction side of the turbine blade. The diffusion slots reduce the velocity of the cooling fluids released from the platform to increase the capacity of the film cooling of downstream platforms.

20 Claims, 3 Drawing Sheets

TURBINE AIRFOIL COOLING SYSTEM WITH PLATFORM COOLING CHANNELS WITH DIFFUSION SLOTS

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Thus, a need exists for a cooling system capable of providing sufficient cooling to turbine airfoils.

Conventional cooling systems positioned in platforms of turbine airfoils typically include internal cooling channels. While these cooling channels reduce the temperature of portions of the platform, there are several drawbacks. For instance, the use of film cooling for the entire blade platform requires that the supply pressure of the cooling air at the blade dead rim cavity be higher than the peak blade platform external gas side pressure, which induces a high leakage flow around the blade attachment region and impacts performance. In addition, conventional designs often include cooling channels extending from the platform edge into the cooling cavities of the airfoil, which causes unacceptable stress levels at the internal airfoil and platform cooling cavities, thereby yielding a low blade life. Furthermore, conventional platform cooling systems often create localized hot spots proximate to the pressure side of the airfoil and proximate to the suction side, further reducing the blade life. Thus, there exists a need for a turbine blade with a platform cooling system that overcomes these shortcomings.

SUMMARY OF THE INVENTION

This invention is directed to a turbine airfoil cooling system for a turbine airfoil used in turbine engines. In particular, the turbine airfoil cooling system includes a plurality of internal cavities positioned between outer walls of the turbine airfoil. The cooling system may include a plurality of platform cooling channels positioned in a platform of the turbine airfoil. In particular, the platform may include one or more suction side platform cooling channels positioned proximate to a suction side of the turbine airfoil and one or more pressure side platform cooling channels positioned proximate to a pressure side of the turbine airfoil. The pressure side platform cooling channels may include one or more diffusion slots extending through a side edge of the platform to cool an adjacent turbine airfoil via film cooling. Such a configuration of cooling fluids creates a double use of cooling fluids that improves the overall platform cooling efficiency, reduces the platform metal temperature and reduces cooling fluid consumption.

The turbine airfoil may be formed, in general, from a generally elongated, hollow airfoil having a leading edge, a trailing edge, a tip section at a first end, a root coupled to the airfoil at an end generally opposite the first end for supporting the airfoil and for coupling the airfoil to a disc and a platform at the intersection between the root and the generally elongated, hollow airfoil and extending generally orthogonal to a longitudinal axis of the generally elongated, hollow airfoil. The airfoil may include a cooling system formed from at least one cavity in the elongated, hollow airfoil.

The cooling system may include one or more suction side platform edge cooling channels in the platform and extending generally along a first outer edge of the platform on a suction side of the generally elongated, hollow airfoil. One or more suction side platform cooling channels may be positioned in the platform and may extend from the at least one suction side platform edge cooling channel to a downstream edge of the platform generally along the suction side of the generally elongated, hollow airfoil. The cooling system may, in one embodiment, include a plurality of suction side platform edge cooling channels positioned generally parallel to each other and tangential to at least a portion of the suction side of the elongated airfoil.

The cooling system may also include one or more pressure side platform cooling channels in the platform and extending generally along an outer edge of the platform on a pressure side of the generally elongated, hollow airfoil. In at least one embodiment, the cooling system may include a plurality of pressure side platform cooling channels extending from the upstream edge toward the downstream edge but terminating before passing under the airfoil. The pressure side platform cooling channels may be positioned generally parallel to each other or in other configurations. One or more, or all of the pressure side platform cooling channels may include a diffusion slot extending at an acute angle from the at least one pressure side platform cooling channel to a second side edge of the platform on the pressure side of the generally elongated, hollow airfoil that is generally opposite to the first side edge. The diffusion slots may be positioned adjacent to each other along the second side edge between an upstream edge to the downstream edge. The diffusion slots may have a ratio of the cross-sectional area of the exhaust opening relative to the cross-sectional area of the inlet opening that is generally between about 2 to 1 and about 7 to 1, and may be about 5 to 1. The pressure side platform cooling channels may include a length to diameter ratio of between about 25 to 1 and about 70 to 1. The diffusion slot may be positioned to direct cooling fluids in close proximity and generally tangential to the suction side of an adjacent turbine blade to create film cooling on the outer surface of the platform of the adjacent turbine blade.

During use, cooling fluids may flow into the cooling system from a cooling fluid supply source. More particularly, cooling fluids may pass into the suction side platform edge cooling channel through an inlet and into the pressure side platform cooling channel through an inlet. The cooling fluids may pass through the suction side platform edge cooling channel and into the suction side platform cooling channels, where the cooling fluids reduce the temperature of the platform and local hot spot. The cooling fluids may be exhausted through the downstream edge of the platform.

The cooling fluids may also flow through the pressure side platform cooling channel where the temperature of the local hot spot is reduced. The cooling fluids may flow into the diffusion slots where the velocity of the cooling fluids is reduced. The cooling fluids may then be released from the diffusion slots of the pressure side platform cooling channel through the exhaust openings. The cooling fluids may form a layer of film cooling air immediately proximate to the outer surface of the platform. This configuration of the cooling system cools the platform with both external film cooling and internal convection. This double use of cooling fluids improves the overall platform cooling efficiency, reduces the platform metal temperature and reduces cooling fluid consumption.

An advantage of this invention is that the diffusion slots of the pressure side platform cooling channels, together with the suction side platform cooling channels, create a double use of cooling fluids that cooling internal aspects of the platform with convective cooling and an external surface of the platform with convective film cooling. Such use of the cooling fluids increases the efficiency of the cooling fluids and reduces the temperature gradient of the platform across its width.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
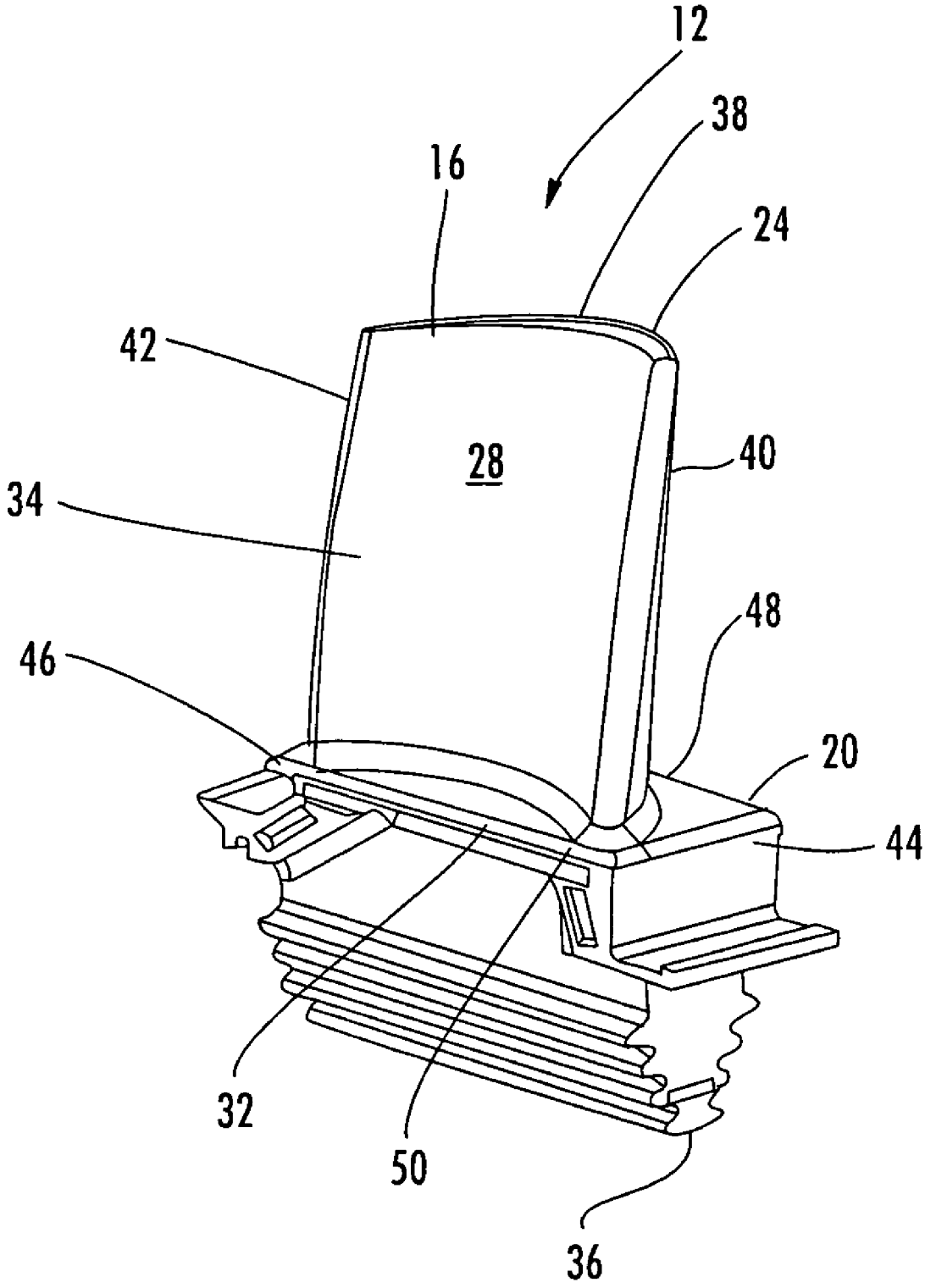
FIG. 1 is a perspective view of a turbine airfoil having features according to the instant invention.
Figure 2:
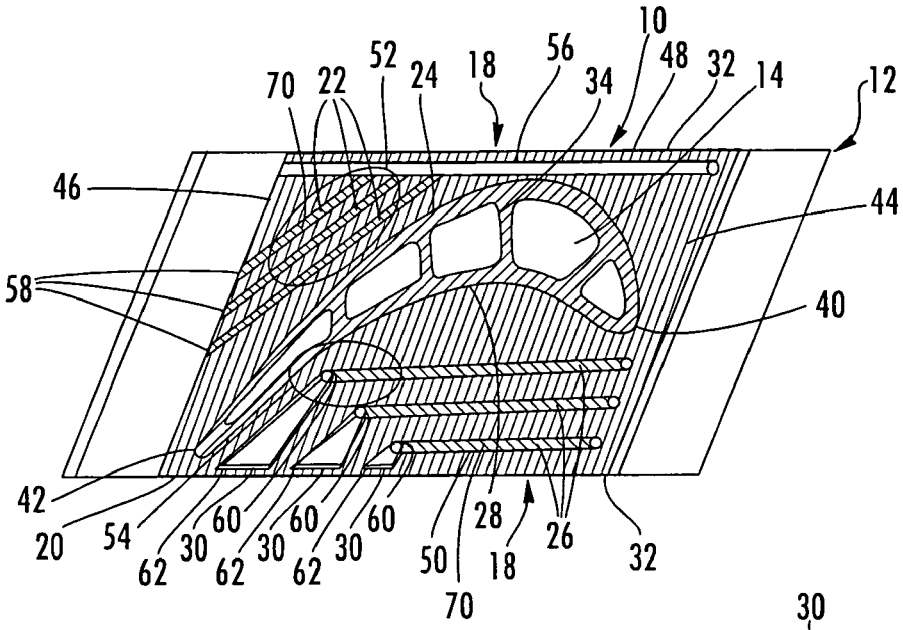
FIG. 2 is a cross-sectional view of the turbine airfoil shown in FIG. 1 taken along line 2-2.

As shown in FIGS. 1-4, this invention is directed to a turbine airfoil cooling system 10 for a turbine airfoil 12 used in turbine engines. In particular, the turbine airfoil cooling system 10 includes a plurality of internal cavities 14, as shown in FIG. 2, positioned between outer walls 16 of the turbine airfoil 12. The cooling system 10 may include a plurality of platform cooling channels 18 positioned in a platform 20 of the turbine airfoil 12. In particular, the platform 20 may include one or more suction side platform cooling channels 22 positioned proximate to a suction side 24 of the turbine airfoil 12 and one or more pressure side platform cooling channels 26 positioned proximate to a pressure side 28 of the turbine airfoil 12. The pressure side platform cooling channels 26 may include one or more diffusion slots 30 extending through a side edge 32 of the platform 20 to cool an adjacent turbine airfoil via film cooling.

As shown in FIG. 1, the turbine airfoil 12 may be formed from a generally elongated, hollow airfoil 34 coupled to a root 36 at the platform 20. The turbine airfoil 12 may be formed from conventional metals or other acceptable materials. The generally elongated airfoil 34 may extend from the root 36 to a tip section 38 and include a leading edge 40 and trailing edge 42. The generally elongated airfoil 34 may have an outer wall 16 adapted for use, for example, in a first stage of an axial flow turbine engine. Outer wall 16 may form a generally concave shaped portion forming pressure side 28 and may form a generally convex shaped portion forming suction side 24. The platform 20 may extend from the airfoil 34, as shown in FIG. 2, in particular, the platform 20 may extend upstream from the airfoil 34 to form an upstream edge 44, downstream to form a downstream edge 46, and outwardly to form a first side edge 48 and a second side edge 50.

Figure 3:
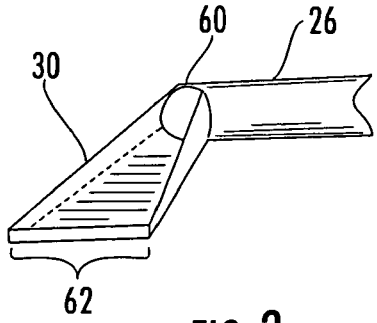
FIG. 3 is a perspective view of a diffusion slot of a pressure side platform cooling channel.

The cooling system 10, as shown in FIGS. 2-3, may include one or more suction side platform cooling channels 22 positioned proximate to a suction side 24 of the turbine airfoil 12 and one or more pressure side platform cooling channels 26 positioned proximate to a pressure side 28 of the turbine airfoil 12. The platform cooling channels 22, 26 may have a generally cylindrical cross-section or may have cross-sections with other appropriate configurations. The platform cooling channels 22, 26 may be positioned to reduce the temperature of local hot spot 52 in the platform 20 proximate to an intersection of the suction side 24 and the platform 20 by the trailing edge 42 and local hot spot 54 in the platform 20 proximate to an intersection of the pressure side 28 and the platform 20. In particular, the cooling system 10 may include one or more suction side platform cooling channels 22. One of the suction side platform cooling channels 22 may be a suction side platform edge cooling channel 56 that extends generally from a position proximate to the upstream edge 44 to the downstream edge 46 generally parallel to the first side edge 48. One or more suction side platform cooling channels 22 may extend from the at least one suction side platform edge cooling channel 56 to the downstream edge 46 of the platform 20 generally along the suction side 24 of the generally elongated, hollow airfoil 34. In at least one embodiment, the cooling system 10 may include a plurality of suction side platform cooling channels 22, such as, but not limited to, three suction side platform cooling channels 22, as shown in FIG. 2. The suction side platform cooling channels 22 may be positioned generally tangential to a portion of the suction side 24 of elongated airfoil 34 and may be aligned with each other. In at least one embodiment, the suction side platform cooling channels 22 may be parallel to each other. The suction side platform cooling channels 22 may exhaust cooling fluids through openings 58 in the downstream edge 46 of the platform 20.

The cooling system 10 may also include one or more pressure side platform cooling channels 26 positioned proximate to a pressure side 28 of the turbine airfoil 12. The pressure side platform cooling channels 26 may extend from proximate the upstream edge 44 of the platform 20 toward the downstream edge 46. The pressure side platform cooling channels 26 may terminate before passing under the elongated airfoil 34. One or more of the pressure side platform cooling channels 26 may include a diffusion slot 30 extending from the pressure side platform cooling channels 26 to the second side edge 50. In at least one embodiment, the cooling system 10 may include a plurality of pressure side platform cooling channels 26, such as, but not limited to three pressure side platform cooling channels 26. The pressure side platform cooling channels 26 may have a generally circular cross-section or may have a cross-section with an alternative configuration. The pressure side platform cooling channels 26 may have a length to diameter ratio of between about 25 to 1 and about 70 to 1. The higher the length to diameter ratio, the more effective the cooling channel is. Higher length to diameter ratios provide more internal convective area for cooling as well as high internal heat transfer coefficients.

Figure 4:
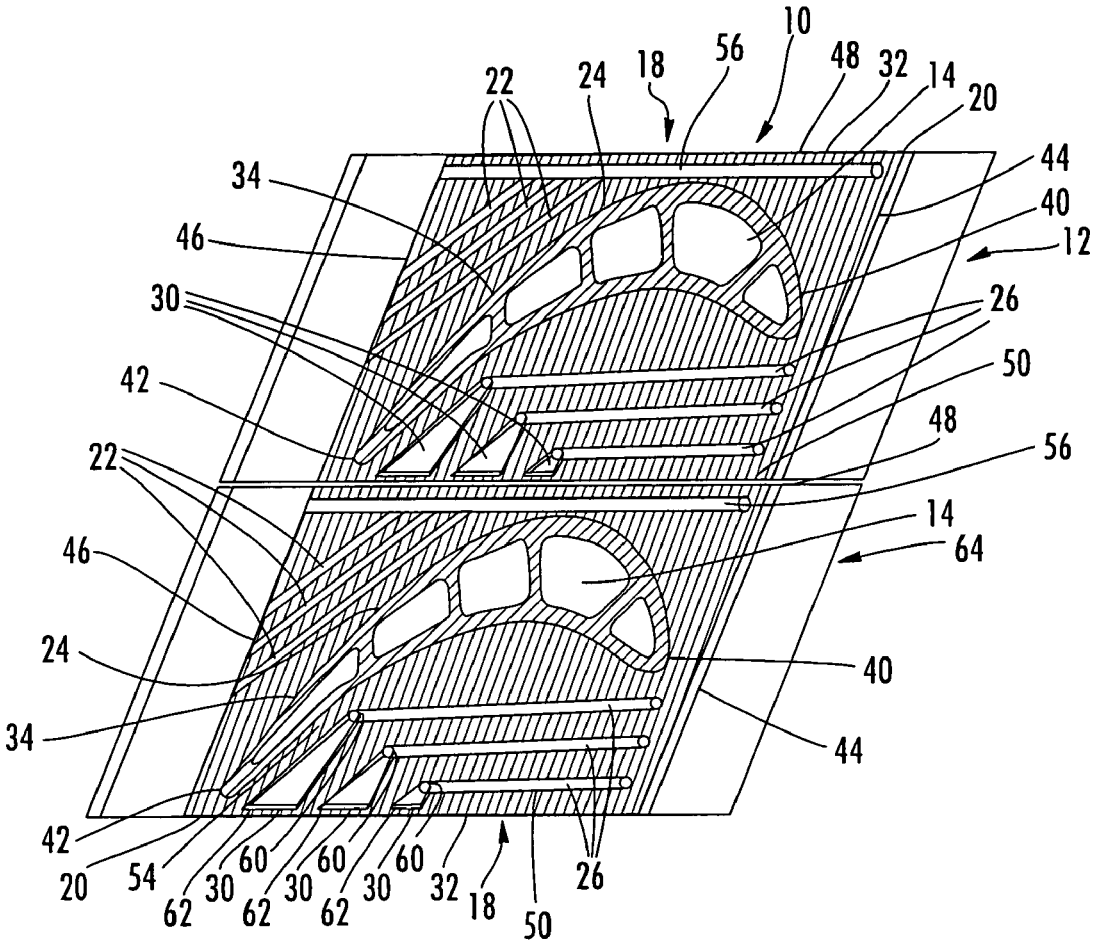
FIG. 4 is a cross-sectional view of the turbine airfoil shown in FIG. 1 taken along line 2-2 in which the turbine airfoil is positioned adjacent to another turbine airfoil.

The diffusion slots 30 may be configured as shown in FIG. 3. In particular, the diffusion slots 30 may transition from a circular inlet opening 60 to a generally rectangular exhaust opening 62. A ratio of the cross-sectional area of the exhaust opening 62 to the cross-sectional area of the inlet opening 60 may be generally between about 2 to 1 and about 7 to 1. In at least one embodiment, the ratio of a cross-sectional area taken at the exhaust opening 62 relative to the cross-sectional area of the inlet opening 60 is generally about 5 to 1. The diffusion slot may have a height to In addition, the thin cross-sectional area of the exhaust opening 62 exhausts the spent cooling fluid effectively to provide a uniform layer of cooling fluids to cool the second side edge 50 as well as outer surfaces of a platform of an adjacent turbine airfoil 64, as shown in FIG. 4.

The suction side platform cooling channels 22 or the pressure side platform cooling channels 26, or both, may include a plurality of trip strips 70, as shown in FIG. 2, for enhancing the turbulence in the channels 22, 26. The trip strips 70 may be positioned at various angles relative to the direction of flow.

During use, cooling fluids may flow into the cooling system 10 from a cooling fluid supply source (not shown). More particularly, cooling fluids may pass into the suction side platform edge cooling channel 56 through inlet 66 and into the pressure side platform cooling channel 26 through inlet 68. The cooling fluids may pass through the suction side platform edge cooling channel 56 and into the suction side platform cooling channels 22, where the cooling fluids reduce the temperature of the platform 20 and local hot spot 52. The cooling fluids may be exhausted through the downstream edge 46 of the platform 20.

The cooling fluids may also flow through the pressure side platform cooling channel 26 where the temperature of the local hot spot 54 is reduced. The cooling fluids may flow into the diffusion slots 30 where the velocity of the cooling fluids is reduced. The cooling fluids may then be released from the diffusion slots of the pressure side platform cooling channel 26 through the exhaust openings 62. The cooling fluids may then impinge on a side surface of an adjacent turbine airfoil 64 and may form a layer of film cooling air immediately proximate to the outer surface of the platform. This configuration of the cooling system 10 cools the platform with both external film cooling and internal convection. This double use of cooling fluids improves the overall platform cooling efficiency, reduces the platform metal temperature and reduces cooling fluid consumption.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, a platform at the intersection between the root and the generally elongated, hollow airfoil and extending generally orthogonal to a longitudinal axis of the generally elongated, hollow airfoil, and a cooling system formed from at least one cavity in the elongated, hollow airfoil;

at least one suction side platform edge cooling channel in the platform and extending generally along a first outer edge of the platform on a suction side of the generally elongated, hollow airfoil;

at least one suction side platform cooling channel in the platform and extending from the at least one suction side platform edge cooling channel to a downstream edge of the platform generally along the suction side of the generally elongated, hollow airfoil such that the at least one suction side platform cooling channel is nonparallel and nonorthogonal relative to the at least one suction side platform edge and the downstream edge of the platform and wherein at least one suction side platform cooling channel is positioned generally tangential to the suction side of an adjacent turbine blade;

at least one pressure side platform cooling channel in the platform and extending generally along an outer edge of the platform on a pressure side of the generally elongated, hollow airfoil; and wherein the at least one pressure side platform cooling channel comprises a diffusion slot extending at an acute angle from the at least one pressure side platform cooling channel to a second side edge of the platform on the pressure side of the generally elongated, hollow airfoil that is generally opposite to the first side edge.

2. The turbine airfoil of claim 1, wherein the at least one pressure side platform cooling channel comprises a plurality of pressure side platform cooling channels.

3. The turbine airfoil of claim 2, wherein the plurality of pressure side platform cooling channels are positioned generally parallel to each other.

4. The turbine airfoil of claim 3, wherein each pressure side platform cooling channel of the plurality of pressure side platform cooling channels comprises a diffusion slot, wherein the diffusion slots are positioned adjacent to each other along the second side edge between an upstream edge to the downstream edge.

5. The turbine airfoil of claim 4, wherein the diffusion slots have a ratio of a cross-sectional area of an exhaust opening relative to a cross-sectional area of an inlet opening that is generally between about 2 to 1 and about 7 to 1.

6. The turbine airfoil of claim 5, wherein the diffusion slots have a ratio of a cross-sectional area of an exhaust opening relative to a cross-sectional area of an inlet opening that is generally about 5 to 1.

7. The turbine airfoil of claim 2, wherein the plurality of pressure side platform cooling channels comprises three pressure side platform cooling channels positioned generally adjacent to each other.

8. The turbine airfoil of claim 1, wherein the at least one pressure side platform cooling channel includes a length to diameter ratio of between about 25 to 1 and about 70 to 1.

9. The turbine airfoil of claim 1, wherein the diffusion slot is positioned to direct cooling fluids in close proximity and generally tangential to the suction side of an adjacent turbine blade.

10. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, a platform at the intersection between the root and the generally elongated, hollow airfoil and extending generally orthogonal to a longitudinal axis of the generally elongated, hollow airfoil, and a cooling system formed from at least one cavity in the elongated, hollow airfoil;

at least one suction side platform edge cooling channel in the platform and extending generally along a first outer edge of the platform on a suction side of the generally elongated, hollow airfoil;

at least one suction side platform cooling channel in the platform and extending from the at least one suction side platform edge cooling channel to a downstream edge of the platform generally along the suction side of the generally elongated, hollow airfoil such that the at least one suction side platform cooling channel is nonparallel and nonorthogonal relative to the at least one suction side platform edge and the downstream edge of the platform and wherein at least one suction side platform cooling channel is positioned generally tangential to the suction side of an adjacent turbine blade;

a plurality of pressure side platform cooling channels in the platform and extending generally along an outer edge of the platform on a pressure side of the generally elongated, hollow airfoil; and wherein at least one of the pressure side platform cooling channels comprises a diffusion slot extending at an acute angle from one of the pressure side platform cooling channels to a second side edge of the platform on the pressure side of the generally elongated, hollow airfoil that is generally opposite to the first side edge.

11. The turbine airfoil of claim 10, wherein the plurality of pressure side platform cooling channels are positioned generally parallel to each other.

12. The turbine airfoil of claim 10, wherein each pressure side platform cooling channel of the plurality of pressure side platform cooling channels comprises a diffusion slot, wherein the diffusion slots are positioned adjacent to each other along the second side edge between an upstream edge to the downstream edge.

13. The turbine airfoil of claim 10, wherein the diffusion slot has a ratio of a cross-sectional area of an exhaust opening relative to a cross-sectional area of an inlet opening that is generally between about 2 to 1 and about 7 to 1.

14. The turbine airfoil of claim 13, wherein the diffusion slot has a ratio of a ratio of a cross-sectional area of an exhaust opening relative to a cross-sectional area of an inlet opening that is generally about 5 to 1.

15. The turbine airfoil of claim 10, wherein the plurality of pressure side platform cooling channels comprise three pressure side platform cooling channels positioned generally adjacent to each other.

16. The turbine airfoil of claim 10, wherein the plurality of pressure side platform cooling channels includes a length to diameter ratio of between about 25 to 1 and about 70 to 1.

17. The turbine airfoil of claim 10, wherein the diffusion slot is positioned to direct cooling fluids in close proximity and generally tangential to the suction side of an adjacent turbine blade.

18. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, a platform at the intersection between the root and the generally elongated, hollow airfoil and extending generally orthogonal to a longitudinal axis of the generally elongated, hollow airfoil, and a cooling system formed from at least one cavity in the elongated, hollow airfoil;

at least one suction side platform edge cooling channel in the platform and extending generally along a first outer edge of the platform on a suction side of the generally elongated, hollow airfoil;

at least one suction side platform cooling channel in the platform and extending from the at least one suction side platform edge cooling channel to a downstream edge of the platform generally along the suction side of the generally elongated, hollow airfoil such that the at least one suction side platform cooling channel is nonparallel and nonorthogonal relative to the at least one suction side platform edge and the downstream edge of the platform;

a plurality of pressure side platform cooling channels positioned generally parallel to each other in the platform and extending generally along an outer edge of the platform on a pressure side of the generally elongated, hollow airfoil;

wherein the pressure side platform cooling channels each comprise a diffusion slot extending at an acute angle from the pressure side platform cooling channels to a second side edge of the platform on the pressure side of the generally elongated, hollow airfoil that is generally opposite to the first side edge;

wherein the diffusion slots are positioned adjacent to each other along the second side edge between an upstream edge to the downstream edge; and wherein the diffusion slot is positioned to direct cooling fluids in close proximity and generally tangential to the suction side of an adjacent turbine blade.

19. The turbine airfoil of claim 18, wherein the diffusion slot has a ratio of a cross-sectional area of an exhaust opening relative to a cross-sectional area of an inlet opening that is generally between about 2 to 1 and about 7 to 1.

20. The turbine airfoil of claim 18, wherein the plurality of pressure side platform cooling channels includes a length to diameter ratio of between about 25 to 1 and about 70 to 1.

* * * * *